United States Patent [19]

Krauss et al.

[11] Patent Number: 4,549,668

[45] Date of Patent: Oct. 29, 1985

[54] LID WITH VENT VALVE

[75] Inventors: Robert Krauss; Klaus Binder, both of Munich, Fed. Rep. of Germany

[73] Assignee: Peroxid-Chemie GmbH, Höllriegelskreuth, Fed. Rep. of Germany

[21] Appl. No.: 630,196

[22] Filed: Jul. 12, 1984

[30] Foreign Application Priority Data

Jul. 15, 1983 [DE] Fed. Rep. of Germany ..... 3325665

[51] Int. Cl.[4] ..... B65D 51/16

[52] U.S. Cl. ..... 220/203; 220/303

[58] Field of Search ..... 220/203, 303, 288, DIG. 32, 220/DIG. 33, 202

[56] References Cited

U.S. PATENT DOCUMENTS

| | | | |
|---|---|---|---|
| 3,189,072 | 6/1965 | Starr | 220/288 X |
| 3,454,183 | 7/1969 | Fuchs | 220/303 |
| 3,985,260 | 10/1976 | Evans | 220/203 |
| 4,165,816 | 8/1979 | Tupper | 220/203 |

FOREIGN PATENT DOCUMENTS

| | | | |
|---|---|---|---|
| 1161459 | 1/1964 | Fed. Rep. of Germany | 220/202 |
| 2758432 | 7/1978 | Fed. Rep. of Germany | 220/203 |
| 2727154 | 9/1978 | Fed. Rep. of Germany | 220/DIG. 32 |

*Primary Examiner*—Allan N. Shoap

*Attorney, Agent, or Firm*—Felfe & Lynch

[57] ABSTRACT

Lid with vent valve for packings of gas-evolving products, especially organic peroxides or hydrogen peroxide, characterized by a bush surrounded flush by an edge of a hole in the lid, especially by an annular collar on the inner side of the lid, having an axial passage widening by way of a conical stage to a hole in the crown of the cap, by a valve ball in the conical stage and by a compression spring which is arranged between a retaining ring of synthetic plastics material, which lies in an annular shoulder of the bush surrounding the axial passage close to the hole, and the valve ball.

8 Claims, 4 Drawing Figures

LID WITH VENT VALVE

Lids of this kind with vent valves, of silicone rubber, as known hitherto, are not suitable for products which cause the vent valve to swell up. Swelling causes the vent valve to become ineffective and then the required security is not presented.

It is the problem of the invention to indicate a lid having a vent valve of the stated kind which is suitable even for packings of gas-evolving products which otherwise effect swelling of the vent valve. More especially the vent valve is to be stable against the actions of all kinds of organic peroxides. The vent valve is to be able stably to possess a uniformly reproducible opening pressure between 0.05 and 0.2 bar. Finally the vent valve is to fit into ordinary caps, especially screw caps.

A combination of (relatively soft) polyethylene for the bush and/or the retaining ring and (relatively hard) polypropylene for the valve ball, and likewise this combination with converse association, are especially preferred here.

The invention will be described hereinafter by means of an example of embodiment with reference to the accompanying drawings, wherein.

Figure 1:
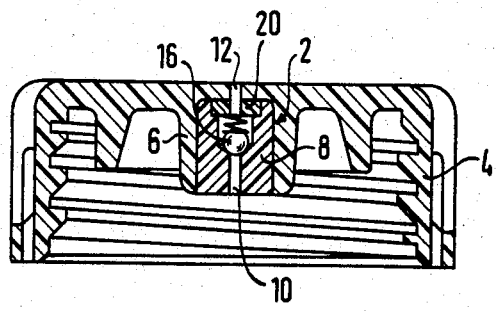
FIG. 1 shows the vent valve in the installed condition.
Figure 3:
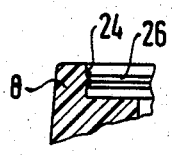
FIG. 3 shows the detail X in FIG. 2.
Figure 2:
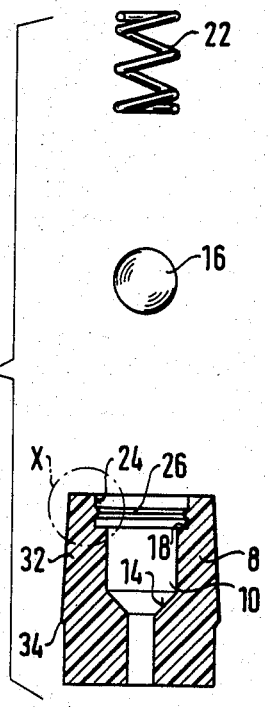
FIG. 2 shows the vent valve according to FIG. 1 in exploded representation.
Figure 4:
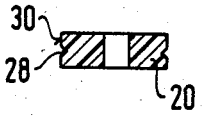
FIG. 4 shows the retaining ring.

In the present example of embodiment the vent valve 2 is inserted into a screw cap 4. On the inner side of the cap 4 there is an annular collar 6 flush surrounding a bush 8 of polyethylene. Axially through the bush 8 there extends a passage 10 which widens by way of a conical stage 14 towards a hole 12 in the crown of the cap 4. A valve ball of polypropylene lies in the conical stage 14. A retaining ring 20 of polyethylene is seated in an annular shoulder 18 of the bush 8 which surrounds the axial passage 10 close to the hole. A compression spring 22 of V4A steel is arranged between the retaining ring 20 and the valve ball 16. If the axial passage 10 has a diameter of 2 mm. in its narrow region and a diameter of 5.9 mm. in its wide region, the valve ball 16 has a diameter of 5 mm. and the compression spring has a diameter of 5.6 mm. and four turns with a wire diameter of 0.5 mm. and finally in the unstressed condition a length of 5.6 mm., the opening pressure of the valve lies stably between 0.05 and 0.2 bar.

The circumferential surface 24 of the annular shoulder 18 is provided with a protruding annular detent flange 26 for reception in a corresponding annular groove 28 in the circumferential surface 30 of the retaining ring 20.

A section 32 of the bush 8 adjoining the cap 4 tapers conically in the direction towards the cap 4 from a diameter 34 which is somewhat larger than the diameter of the inner surface of the annular collar to the diameter of the inner surface of the annular collar.

For assembly, the bush 8 with the valve ball 16 and the compression spring 22 is pressed flush into the annular collar 6. If the cap is screwed on to a vessel with a gas-evolving product, in the case of excess pressure the valve ball 16 is pressed against the compression spring 22 and thus the axial passage 10 is opened to the hole 12.

Vent valves of the kind as described were stored over three months in TBPEH and then, still unswollen, proved stably to have a reproducible opening pressure between 0.05 and 0.15 bar.

The conical taper of the bush permits its simple introduction into the annular collar 6 and nevertheless a firm seating in the annular collar 6.

We claim:

1. A lid with vent valve for packings of gas-evolving products such as organic peroxides or hydrogen peroxide, comprising a lid having an inner side and an outer crown and having a hole extending to and through the inner side and the outer crown and having an annular collar formed on the inner side, a bush including an annular shoulder formed therein and being surrounded flush by the annular collar formed by the lid, the bush having an axial passage widening by way of a conical stage and extending to the hole, a retaining ring which lies in the annular shoulder of the bush and surrounds the axial passage close to the hole, a valve ball in the conical stage and a compression spring which is arranged between the valve ball and the retaining ring, the annular collar having an inner surface which is cylindrical and having an end which is open across the full diameter of the inner surface in a direction away from the outer crown, and the bush including means, comprising at least one section adjoining the annular collar and having a circumferential surface tapering conically from a diameter somewhat greater than the diameter of the inner surface of the annular collar to the diameter of the inner surface of the annular collar, in the direction towards the outer crown, for causing the bush to remain firmly within the annular collar.

2. The lid of claim 1, wherein at least one of the bush and the retaining ring is formed of synthetic plastics material.

3. The lid of claim 2, wherein the synthetic plastics material is a material selected from the group consisting of polyethylene, polypropylene and tetrafluoroethylene.

4. The lid of claim 1, wherein the valve ball is formed of synthetic plastics material.

5. The lid of claim 4, wherein the synthetic plastics material is a material selected from the group consisting of polyethylene, polypropylene and tetrafluoroethylene.

6. The lid of claim 1, wherein at least one of the bush and the retaining ring is formed of high-grade steel.

7. The lid of claim 1, wherein the valve ball is formed of high-grade steel.

8. The lid of claim 1, wherein the circumferential surface of the annular shoulder comprises a protruding annular detent flange for reception in a corresponding annular groove in the circumferential surface of the retaining ring.

* * * * *